US010639929B2

(12) United States Patent
Ueda

(10) Patent No.: US 10,639,929 B2
(45) Date of Patent: May 5, 2020

(54) THERMAL TRANSFER APPARATUS

(71) Applicant: DGSHAPE Corporation, Hamamatsu-shi, Shizuoka (JP)

(72) Inventor: Jun Ueda, Hamamatsu (JP)

(73) Assignee: DGSHAPE CORPORATION, Shizuoka (JP)

( * ) Notice: Subject to any disclaimer, the term of this patent is extended or adjusted under 35 U.S.C. 154(b) by 0 days.

(21) Appl. No.: 16/182,697

(22) Filed: Nov. 7, 2018

(65) Prior Publication Data

US 2019/0152254 A1 May 23, 2019

(30) Foreign Application Priority Data

Nov. 21, 2017 (JP) ..... 2017-223759

(51) Int. Cl.
*B44C 1/17* (2006.01)
*B41M 3/12* (2006.01)
*B41F 16/00* (2006.01)

(52) U.S. Cl.
CPC ..... *B44C 1/1716* (2013.01); *B41F 16/006* (2013.01); *B41F 16/0046* (2013.01); *B41M 3/12* (2013.01)

(58) Field of Classification Search
CPC ..... B32B 37/025; B32B 37/142; B32B 41/00; B32B 2041/04; B41F 16/00; B41F 16/0046; B41F 16/006; B41F 16/008; B41F 16/0086; B41M 3/12; B44C 1/1716; B44C 1/1729; B65C 1/00
See application file for complete search history.

(56) References Cited

U.S. PATENT DOCUMENTS 5,521,722 A * 5/1996 Colvill ..... G06F 3/1208 101/211
2017/0015058 A1* 1/2017 Ueda ..... B29C 64/386
2019/0111720 A1* 4/2019 Takahashi ..... B41M 5/38214
2019/0160802 A1* 5/2019 Kanno ..... B41F 16/0046
2019/0160857 A1* 5/2019 Hayashi ..... B44C 1/1716

FOREIGN PATENT DOCUMENTS

JP 5926083 B2 5/2016

* cited by examiner

*Primary Examiner* — George R Koch
(74) *Attorney, Agent, or Firm* — Keating & Bennett, LLP

(57) ABSTRACT

A controller includes a memory that stores image data in a vector format representing a shape in the vector format, a contour extractor that extracts a contour of the shape based on the image data in the vector format, a reduced-size contour generator that generates reduced-size contours inside the contour by sequentially reducing inwardly the contour extracted by the contour extractor, and a moving controller that controls a carriage moving mechanism such that a foil transfer tool moves along the reduced-size contours and the contour in order from an innermost reduced-size contour to the contour at an outermost side.

8 Claims, 9 Drawing Sheets

THERMAL TRANSFER APPARATUS

CROSS REFERENCE TO RELATED APPLICATIONS

This application claims the benefit of priority to Japanese Patent Application No. 2017-223759 filed on Nov. 21, 2017. The entire contents of this application are hereby incorporated herein by reference.

BACKGROUND OF THE INVENTION

1. Field of the Invention

The present invention relates to a thermal transfer apparatus. In particular, the present invention relates to a thermal transfer apparatus that transfers foil onto a transfer object using thermal transfer foil.

2. Description of the Related Art

A decorative process by a heat transfer technique using thermal transfer foil (also called a heat transfer sheet) has been performed to date for purposes such as enhancement of aesthetic design. The thermal transfer foil is generally constituted by stacking a base material, a decorative layer, and an adhesive layer in this order. In transfer (i.e., transfer of thermal transfer foil to a transfer object), thermal transfer foil is overlaid on the transfer object such that an adhesive layer of the foil contacts the transfer object, and the thermal transfer foil is heated while pressing the thermal transfer foil from above with a foil transfer tool (e.g., a laser pen). Accordingly, the adhesive layer in a pressed portion of the thermal transfer foil is melted and attached to the surface of the transfer object, and then is cured by heat dissipation. Consequently, the base material of the thermal transfer foil is separated from the transfer object so that a decorative layer having a shape corresponding to the portion stamped with foil can be attached to the transfer object together with the adhesive layer. In this manner, the surface of the transfer object is provided with a decoration of foil having an intended shape (e.g., a figure or a character).

Japanese Patent No. 5926083, for example, discloses a technique of transferring foil to a transfer object using a foil transfer tool that applies laser light.

In transferring thermal transfer foil onto the transfer object with the foil transfer tool, image data representing the shape (e.g., a figure or a character) of foil to be provided to the transfer object is used. The image data includes vector data represented in a vector format and raster data represented in a raster format.

In the case of transferring foil onto a transfer object using vector data, for example, a foil transfer tool is first moved along the contour of the shape such as a figure or a character. The foil transfer tool is then moved along the contour of a shape reduced in size (reduced-size shape) and further moved along the contour of a shape further reduced in size. This process is sequentially performed inward from the original contour, thereby transferring foil onto the transfer object. An inventor of preferred embodiments of the present invention discovered that when the foil transfer tool is moved inward from an original contour, foil is easily crinkled and cannot be accurately transferred onto the transfer object.

In the case of transferring foil onto the transfer object using raster format data, since the foil transfer tool is configured to move in units of pixels, there arises a problem that jaggies (stepped notches) occur on the contour of some shapes (e.g., a circle) so that the foil cannot be accurately transferred onto the transfer object in some cases.

SUMMARY OF THE INVENTION

In view of the foregoing circumstances, preferred embodiments of the present invention provide thermal transfer apparatuses each capable of transferring foil onto a transfer object more accurately.

A thermal transfer apparatus according to a preferred embodiment of the present invention includes a stand that holds a transfer object; a foil transfer tool that presses thermal transfer foil placed on the transfer object and heats the thermal transfer foil to transfer foil having a shape onto the transfer object; a moving mechanism that moves one of the stand and the foil transfer tool relative to another of the stand and the foil transfer tool; and a controller communicably connected to the foil transfer tool and the moving mechanism to control the foil transfer tool and the moving mechanism, wherein the controller includes a memory that stores image data in a vector format representing the shape in the vector format, a contour extractor that extracts a contour of the shape based on the image data in the vector format, a reduced-size contour generator that generates a plurality of reduced-size contours inside the contour by sequentially reducing the contour extracted by the contour extractor inward, and a moving controller that controls the moving mechanism such that the foil transfer tool moves along the plurality of reduced-size contours and the contour in order from an innermost reduced-size contour to the contour, the innermost reduced-size contour being one of the plurality of reduced-size contours located at an innermost side, the contour is located at an outermost side among the plurality of reduced-size contours and the contour.

In a thermal transfer apparatus according to a preferred embodiment of the present invention, the moving controller controls the moving mechanism such that the foil transfer tool sequentially moves along the plurality of reduced-size contours and the contour in order from the innermost reduced-size contour to the contour at the outermost side. In this manner, since transfer of the thermal transfer foil onto the transfer object is sequentially performed from the inside to the outside of the contour, crinkles of the thermal transfer foil are reduced or prevented during the foil transfer so that the thermal transfer foil is able to be more accurately transferred onto the transfer object.

A thermal transfer apparatus according to another preferred embodiment of the present includes a stand that holds a transfer object; a foil transfer tool that presses a thermal transfer foil placed on the transfer object and heats the thermal transfer foil to transfer foil having a shape onto the transfer object; a moving mechanism that moves one of the stand and the foil transfer tool relative to another of the stand and the foil transfer tool; and a controller communicably connected to the foil transfer tool and the moving mechanism to control the foil transfer tool and the moving mechanism, wherein the controller includes a memory that stores mage data in a raster format representing the shape in the raster format, a data converter that converts the image data in the raster format to image data in a vector format, a contour extractor that extracts a contour of the shape based on the image data in the vector format, a first moving controller that controls the moving mechanism such that the foil transfer tool moves along the contour, and a second moving controller that controls the moving mechanism based on the image data in the raster format such that the foil transfer tool moves in units of pixels in a region inside the contour.

In a thermal transfer apparatus according to a preferred embodiment of the present invention, the first moving controller controls the moving mechanism such that the foil transfer tool moves along the contour. Thus, jaggies do not occur on the contour of the thermal transfer foil transferred onto the transfer object. Based on the image data in the raster format, the second moving controller controls the moving mechanism such that the foil transfer tool moves in units of pixels in a region inside the contour. Thus, the thermal transfer foil is able to be transferred onto the transfer object without gaps over the entire region or substantially the entire region inside the contour. In this manner, the foil transfer tool is caused to move using different pieces of data for portions of shapes of the thermal transfer foil to be transferred onto the transfer object so that the thermal transfer foil is able to be more accurately transferred onto the transfer object.

The preferred embodiments of the present invention provide thermal transfer apparatuses each capable of transferring foil onto the transfer object more accurately.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
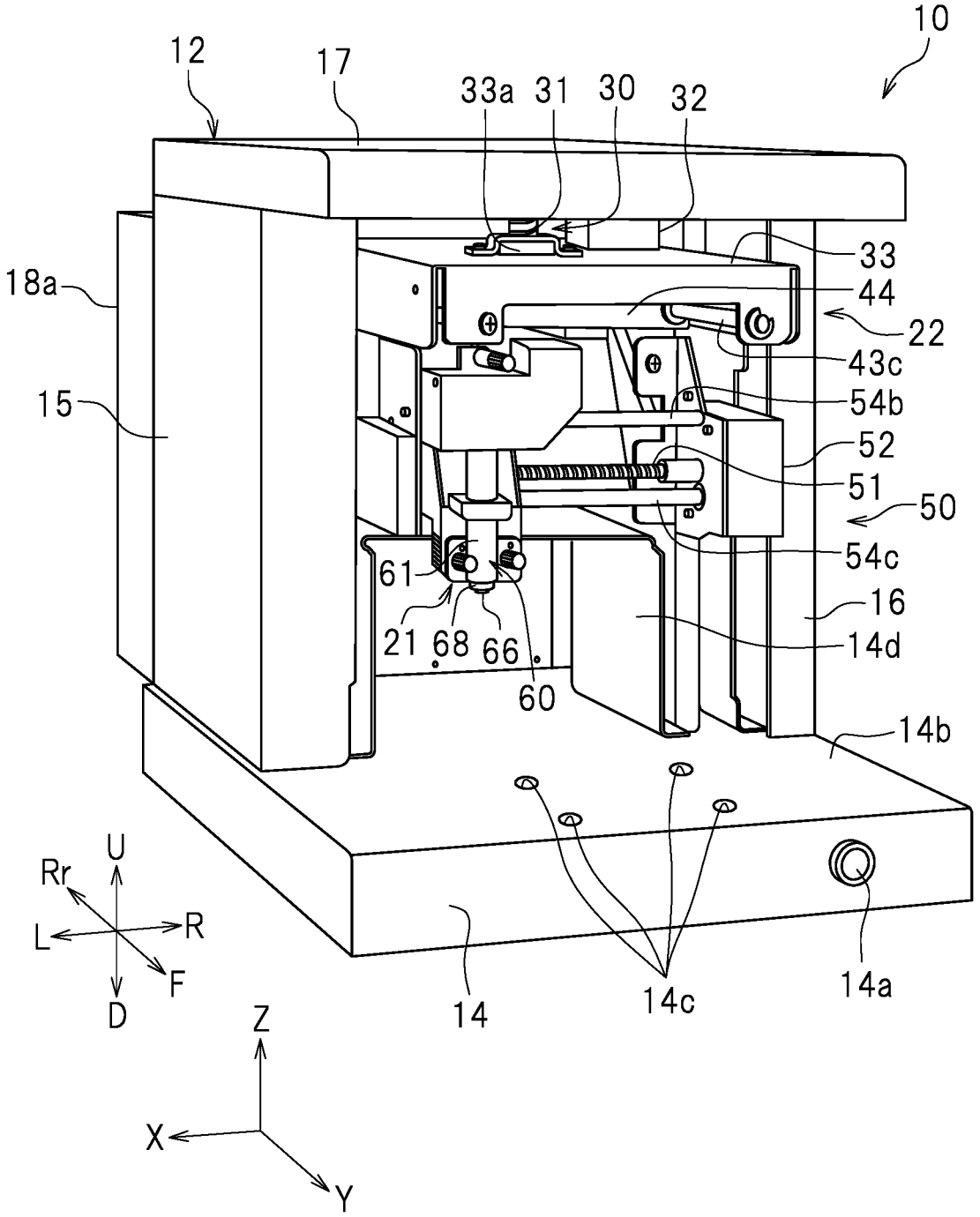
FIG. 1 is a perspective view schematically illustrating a thermal transfer apparatus according to a preferred embodiment of the present invention.

Preferred embodiments of the present invention will be described hereinafter with reference to the drawings. The preferred embodiments described herein are, of course, not intended to particularly limit the present invention. Elements and features having the same functions are denoted by the same reference numerals, and description for the same members and elements will not be repeated or will be simplified as appropriate.

Figure 2:
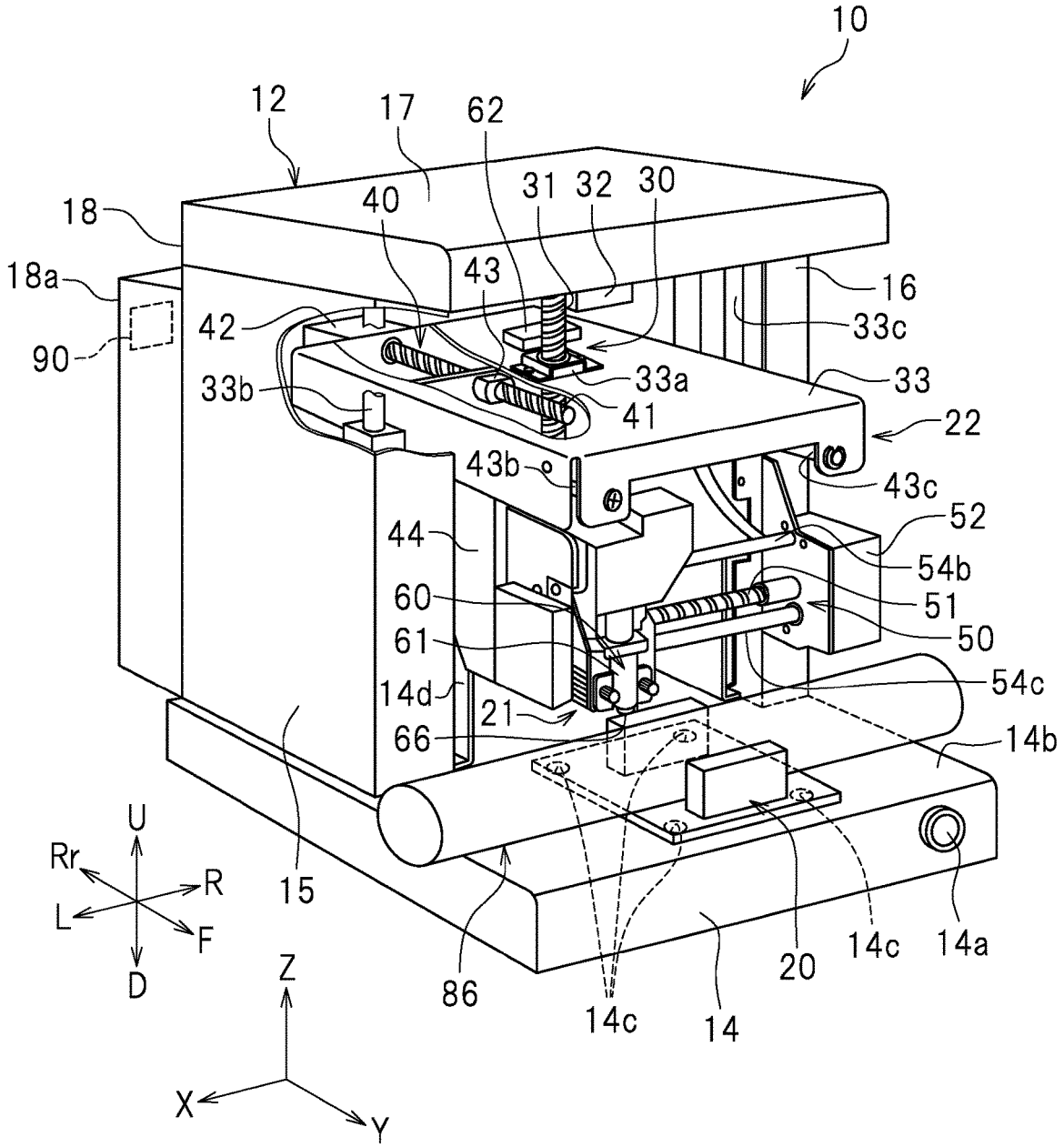
FIG. 2 is a partially broken perspective view schematically illustrating a thermal transfer apparatus according to a preferred embodiment of the present invention.
Figure 3:
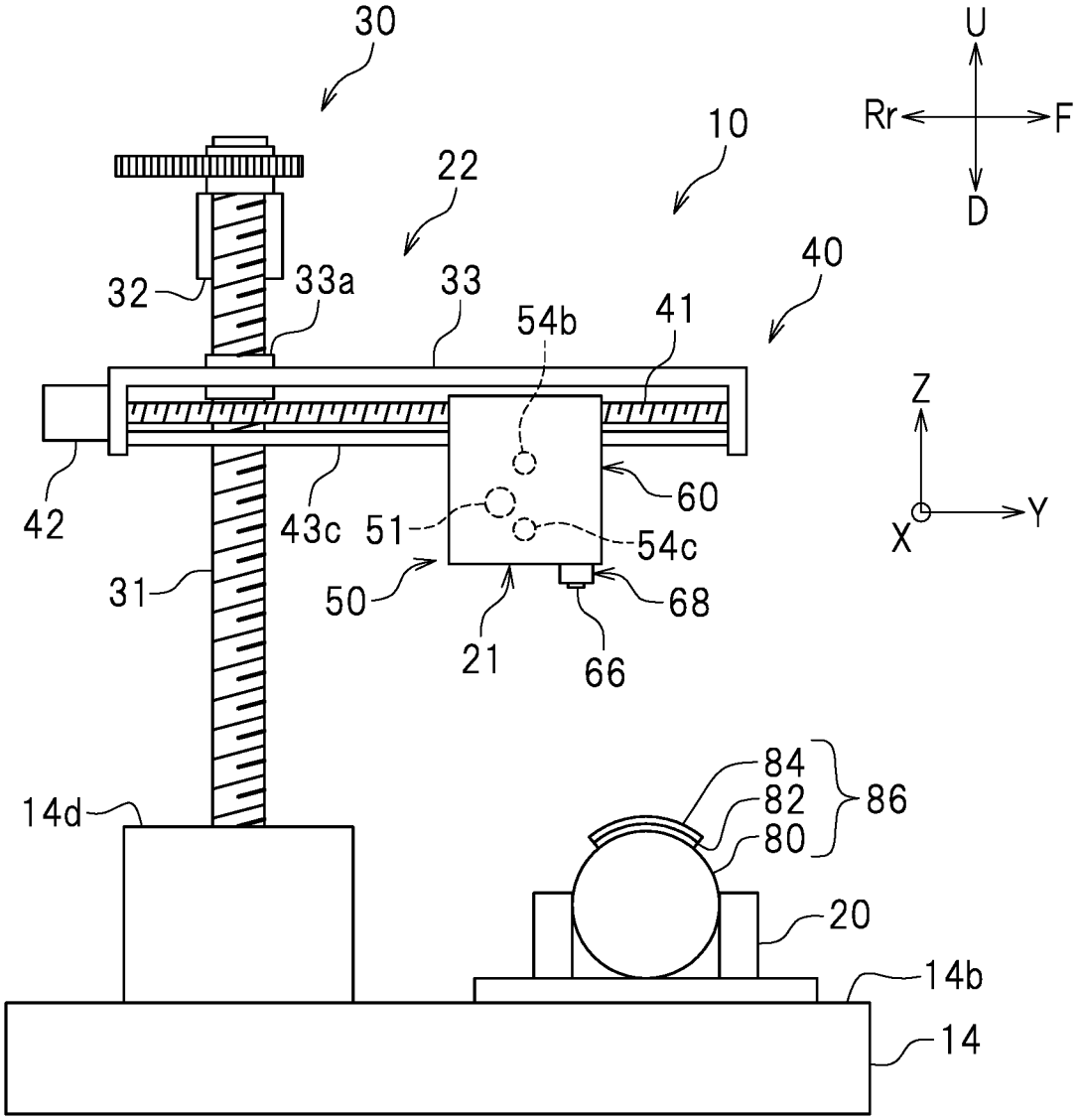
FIG. 3 is a left side view schematically illustrating a carriage moving mechanism according to a preferred embodiment of the present invention.

First, a configuration of a thermal transfer apparatus 10 according to a first preferred embodiment of the present invention will be described. FIG. 1 is a perspective view illustrating the thermal transfer apparatus 10. FIG. 2 is a partially broken perspective view schematically illustrating an aspect of the thermal transfer apparatus 10 in foil transfer. FIG. 3 is a left side view schematically illustrating a carriage moving mechanism 22. In the following description, left, right, up, and down refer to left, right, up, and down, respectively, when an operator (user) in front of the thermal transfer apparatus 10 sees a power supply switch 14*a*. When seen from the operator, a direction toward the thermal transfer apparatus 10 will be referred to as rearward, and a direction away from the thermal transfer apparatus 10 will be referred to as forward. Characters F, Rr, L, R, U, and D in the drawings represent front, rear, left, right, up, and down, respectively. Suppose axes orthogonal to one another are an X axis, a Y axis, and a Z axis, the thermal transfer apparatus 10 according to this preferred embodiment is placed on a plane constituted by the X axis and the Y axis. Here, the X axis extends leftward and rightward. The Y axis extends forward and rearward. The Z axis extends upward and downward. It should be noted that these directions are defined simply for convenience of description, and do not limit the state of installation of the thermal transfer apparatus 10.

As illustrated in FIG. 3, the thermal transfer apparatus 10 is an apparatus that applies a decorative layer in a sheet-shaped thermal transfer foil 82 to a surface of transfer object 80 by pressing and heating the thermal transfer foil 82 and a light absorption film 84 by using a foil transfer tool 60 described later with the thermal transfer foil 82 and the light absorption film 84 overlaid on the transfer object 80. The thermal transfer foil 82 is indirectly pressed against the foil transfer tool 60 with the light absorption film 84 interposed therebetween. With some combinations of the transfer object 80 and the thermal transfer foil 82, the light absorption film 84 may be omitted. In the following description, objects of "pressing and heating," such as the transfer object 80, the thermal transfer foil 82, and the light absorption film 84, will be collectively referred to as a process object 86.

The transfer object 80 is not limited to a specific material and a specific shape. Examples of materials for the transfer object 80 include metals such as gold, silver, copper, platinum, brass, aluminum, iron, titanium, and stainless, resins such as acrylic, polyvinyl chloride (PVC), polyethylene terephthalate (PET), and polycarbonate (PC), papers such as plain paper, drawing paper, and Japanese paper, and rubbers.

The thermal transfer foil 82 may be, but is not limited to, transfer foil commercially available for heat transfer. The thermal transfer foil 82 may be a stack of a base material, a decorative layer, and an adhesive layer in this order. The decorative layer in the thermal transfer foil 82 includes, for example, metallic foil such as gold foil and sliver foil, half metallic foil, pigment foil, multi-color printing foil, hologram foil, and electrostatic destruction measures foil. The thermal transfer foil 82 may have a band shape or a sheet shape. The thermal transfer foil 82 is placed on the transfer object 80. The thermal transfer foil 82 may further include a light absorption layer between the base material and the decorative layer. In the case where the thermal transfer foil 82 includes the light absorption layer, the base material is made of a transparent material. The light absorption layer has a configuration similar to that of the light absorption film 84 described later. In the case where the thermal transfer foil 82 includes the light absorption layer, the thermal transfer apparatus 10 does not need to include the light absorption film 84 in some cases. Even in the case where the thermal transfer foil 82 includes the light absorption layer, the thermal transfer apparatus 10 preferably includes the light absorption film 84.

Some configurations of the thermal transfer foil 82 to be used may have no or poor light absorption property to light applied from a light source 62 of the foil transfer tool 60 described later. In such cases, the light absorption film 84 is able to be overlaid on top of the thermal transfer foil 82 and used as the process object 86. The light absorption film 84 refers to a sheet structured to efficiently absorb light in a predetermined wavelength range (laser light) applied from the light source 62 of the foil transfer tool 60 and capable of converting optical energy to thermal energy. The light absorption film 84 preferably has a heat resistance at about 100° C. to about 200° C., for example. The light absorption film 84 preferably is made of a resin such as polyimide, for example. The light absorption film 84 preferably is monochrome, for example. From the viewpoint of efficiently converting optical energy to thermal energy, the hue of the light absorption film 84 is preferably complementary to the color of laser light applied from the light source 62. For example, in a case where laser light from the light source 62 is blue, the light absorption film 84 is preferably yellow. The light absorption film 84 may be provided with a protective film to increase strength as necessary. The protective film preferably has a light absorption property significantly lower than that of the light absorption film 84, for example. The protective film preferably has a light transmittance higher than that of the light absorption film 84, and is, for example, transparent. The protective film is not limited to a specific material. The protective film preferably is defined by a plastic film such as polyester, for example.

As illustrated in FIG. 1, the thermal transfer apparatus 10 preferably has a box shape, for example. The thermal transfer apparatus 10 includes a housing 12 that is open at the front, a carriage moving mechanism 22 disposed in the housing 12, a carriage 21, and the foil transfer tool 60. The housing 12 includes a bottom wall 14, a left side wall 15, a right side wall 16, an upper wall 17, and a rear wall 18 (see FIG. 2). The housing 12 is preferably made of a steel plate, for example.

As illustrated in FIG. 2, a fixture 20 such as a vice is detachably attached to the bottom wall 14. The fixture 20 is a stand that holds the transfer object 80 (i.e., the process object 86). A front region of the bottom wall 14 is a fixture placing region 14*b* to place the fixture 20. A center portion of the fixture placing region 14*b* preferably includes four attachment holes 14*c* to attach the fixture 20, for example. A front surface of the bottom wall 14 is provided with the power supply switch 14*a*.

As illustrated in FIG. 2, the left side wall 15 extends upward at the left end of the bottom wall 14. The left side wall 15 is perpendicular or substantially perpendicular to the bottom wall 14. The right side wall 16 extends upward at the right end of the bottom wall 14. The right side wall 16 is perpendicular or substantially perpendicular to the bottom wall 14. The left side wall 15 and the right side wall 16 support the carriage 21 described later. The rear wall 18 extends upward at the rear end of the bottom wall 14. The rear wall 18 is connected to the rear end of the left side wall 15 and the rear end of the right side wall 16. The rear wall 18 is provided with a box-shaped case 18*a*. The case 18*a* houses a controller 90 described later. The upper wall 17 is connected to the upper end of the left side wall 15, the upper end of the right side wall 16, and the upper end of the rear wall 18. A portion of a first moving mechanism 30 described later is disposed on the upper wall 17. A region surrounded by the bottom wall 14, the left side wall 15, the right side wall 16, the upper wall 17, and the rear wall 18 is an internal space of the housing 12.

The internal space of the housing 12 is a space where the thermal transfer foil 82 is transferred onto the transfer object 80. The carriage 21 and the carriage moving mechanism 22 that moves the carriage 21 in three dimensions are provided in the internal space. The carriage moving mechanism 22 is an example of the moving mechanism. The carriage moving mechanism 22 includes the first moving mechanism 30 that moves the carriage 21 along the Z axis, a second moving mechanism 40 that moves the carriage 21 along the Y axis, and a third moving mechanism 50 that moves the carriage 21 along the X axis. The carriage 21 is movable relative to the fixture 20 (i.e., the process object 86) by the first moving mechanism 30, the second moving mechanism 40, and the third moving mechanism 50. The first moving mechanism 30, the second moving mechanism 40, and the third moving mechanism 50 are disposed above the bottom wall 14.

As illustrated in FIG. 1, the first moving mechanism 30 is a mechanism that moves the carriage 21 along the Z axis (upward and downward). The first moving mechanism 30 preferably includes a feed screw mechanism including a Z-axis feed screw rod 31, a Z-axis feed motor 32, and a feed nut 33*a*. The Z-axis feed screw rod 31 extends along the Z axis. The Z-axis feed screw rod 31 includes a helical screw groove. An upper portion of the Z-axis feed screw rod 31 is fixed to the upper wall 17. An upper end portion of the Z-axis feed screw rod 31 penetrates the lower surface of the upper wall 17 along the Z axis, and is partially disposed inside the upper wall 17. A lower end portion of the Z-axis feed screw rod 31 is rotatably supported on a frame 14*d* (see also FIG. 3). The frame 14*d* is fixed onto the bottom wall 14. The Z-axis feed motor 32 is an electric motor. The Z-axis feed motor 32 is connected to the controller 90 (see FIG. 2). The Z-axis feed motor 32 is fixed to the upper wall 17. A driving shaft of the Z-axis feed motor 32 penetrates the lower surface of the upper wall 17 along the Z axis and is partially disposed inside the upper wall 17. In the upper wall 17, the Z-axis feed screw rod 31 is coupled to the Z-axis feed motor 32. The Z-axis feed motor 32 causes the Z-axis feed screw rod 31 to rotate.

As illustrated in FIG. 2, the feed nut 33*a* including a screw thread is engaged with the Z-axis feed screw rod 31. The feed nut 33*a* is coupled to an elevation base 33. The feed nut 33*a* penetrates the upper surface of the elevation base 33 along the Z axis. The elevation base 33 is supported on the Z-axis feed screw rod 31 with the feed nut 33*a* interposed therebetween. The elevation base 33 is parallel or substantially parallel to the bottom wall 14. The lengths of the elevation base 33 along the X axis and the Y axis are larger than the lengths of the fixture placing region 14*b* along the X axis and the Y axis. Slide shafts 33*b* and 33*c* each extending along the Z axis are provided at the inner sides of the left side wall 15 and the right side wall 16. The slide shafts 33*b* and 33*c* are parallel or substantially parallel to the Z-axis feed screw rod 31. The slide shafts 33*b* and 33*c* enable the elevation base 33 to slide along the Z axis. When the Z-axis feed motor 32 is driven, rotation of the Z-axis feed screw rod 31 causes the elevation base 33 to move up and down along the slide shafts 33*b* and 33*c*. The second moving mechanism 40 and the third moving mechanism 50 are coupled to the elevation base 33. Thus, the second moving mechanism 40 and the third moving mechanism 50 integrally move up and down with upward and downward movement of the elevation base 33.

As illustrated in FIG. 2, the second moving mechanism 40 moves the carriage 21 along the Y axis (forward and rearward). The second moving mechanism 40 preferably includes a feed screw mechanism including a Y-axis feed screw rod 41, a Y-axis feed motor 42, and a feed nut 43. The Y-axis feed screw rod 41 extends along the Y axis. The Y-axis feed screw rod 41 is disposed on the elevation base 33. The Y-axis feed screw rod 41 includes a helical screw groove. A rear end portion of the Y-axis feed screw rod 41 is coupled to the Y-axis feed motor 42. The Y-axis feed motor 42 is an electric motor. The Y-axis feed motor 42 is connected to the controller 90. The Y-axis feed motor 42 is fixed to the rear of the elevation base 33. The Y-axis feed motor 42 causes the Y-axis feed screw rod 41 to rotate. A feed nut 43 including a screw thread is engaged with a screw groove of the Y-axis feed screw rod 41. A pair of slide shafts 43*b* and 43*c* extending along the Y axis is disposed on the elevation base 33. The two slide shafts 43*b* and 43*c* are parallel or substantially parallel to the Y-axis feed screw rod 41. A slide base 44 is provided on the slide shafts 43*b* and 43*c* to be slidable along the Y axis. When the Y-axis feed motor 42 is driven, rotation of the Y-axis feed screw rod 41 causes the slide base 44 to move forward and rearward along the slide shafts 43*b* and 43*c*.

As illustrated in FIG. 1, the third moving mechanism 50 moves the carriage 21 along the X axis (leftward and rightward). The third moving mechanism 50 preferably includes a feed screw mechanism including an X-axis feed screw rod 51, an X-axis feed motor 52, and an unillustrated feed nut. The X-axis feed screw rod 51 extends along the X axis. The X-axis feed screw rod 51 is disposed ahead of the slide base 44. The X-axis feed screw rod 51 includes a helical screw groove. An end of the X-axis feed screw rod 51 is coupled to the X-axis feed motor 52. The X-axis feed motor 52 is an electric motor. The X-axis feed motor 52 is connected to the controller 90 (see FIG. 2). The X-axis feed motor 52 is fixed to the right wall surface extending ahead of the slide base 44. The X-axis feed motor 52 causes the X-axis feed screw rod 51 to rotate. A feed nut including a screw thread is engaged with a screw groove of the X-axis feed screw rod 51. A pair of slide shafts 54*b* and 54*c* extending along the X axis is disposed ahead of the slide base 44. The two slide shafts 54*b* and 54*c* are parallel or substantially parallel to the X-axis feed screw rod 51. The carriage 21 is disposed on the slide shafts 54*b* and 54*c* to be slidable along the X axis. When the X-axis feed motor 52 is driven, rotation of the X-axis feed screw rod 51 causes the carriage 21 to move leftward and rightward along the slide shafts 54*b* and 54*c*.

Figure 4:
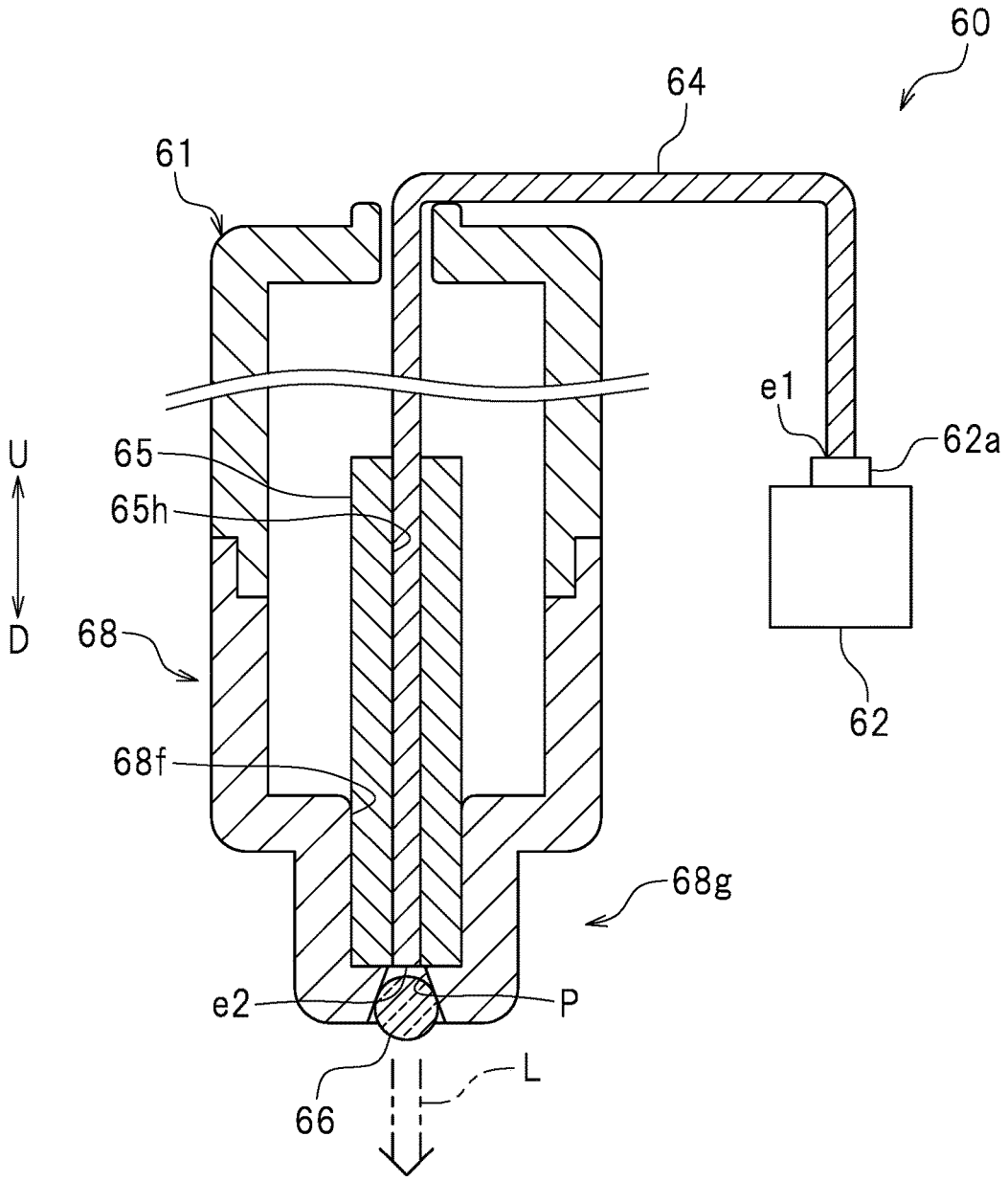
FIG. 4 is a cross-sectional view schematically illustrating a configuration of a foil transfer tool according to a preferred embodiment of the present invention.

FIG. 4 is a cross-sectional view schematically illustrating the thermal transfer tool 60 according to a preferred embodiment of the present invention. The foil transfer tool 60 is mounted on the carriage 21 (see FIG. 1). The foil transfer tool 60 is disposed above the fixture 20. The foil transfer tool 60 presses the thermal transfer foil 82 placed on the transfer object 80 while heating the thermal transfer foil 82. In this preferred embodiment, the foil transfer tool 60 presses the thermal transfer foil 82 and the light absorption film 84 while applying laser light to the light absorption film 84. The "pressing the thermal transfer foil 82" includes a case where the foil transfer tool 60 (e.g., a pressing body 66 described later) contacts the thermal transfer foil 82 to press the thermal transfer foil 82 directly and a case where the foil transfer tool 60 (e.g., the pressing body 66) presses the thermal transfer foil 82 indirectly with the light absorption film 84 or a protective film interposed between the foil transfer tool 60 and the thermal transfer foil 82. The foil transfer tool 60 is a device that applies laser light to the thermal transfer foil 82 for heat supply. The foil transfer tool 60 includes the light source 62, a pen body 61, and the pressing body 66 fixed to the lower end of the pen body 61.

The light source 62 supplies light as a heat source to the light absorption layer of the thermal transfer foil 82 and the light absorption film 84. The light source 62 is disposed on the upper surface of the elevation base 33. Light supplied to the light absorption layer of the thermal transfer foil 82 and the light absorption film 84 is converted to thermal energy in the light absorption layer and the light absorption film 84 and heats the thermal transfer foil 82. The light source 62 according to the present preferred embodiment preferably includes a laser diode (LD) and an optical system, for example. The light source 62 is connected to the controller 90. Switching between application (on) and non-application (off) of laser light from the light source 62, energy of the laser light, and so forth are controlled by the controller 90. Since laser light shows a high response speed, a change in, for example, energy of the laser light as well as switching between application and non-application of the light are able to be performed quickly. Accordingly, laser light having desired properties is able to be applied to the light absorption layer of the thermal transfer foil 82 and the light absorption film 84.

The pen body 61 preferably has an elongated cylindrical shape, for example. The pen body 61 is oriented to have its longitudinal direction coincide with the Z axis. The axis of the pen body 61 extends upward and downward. The pen body 61 preferably includes optical fibers 64 and a ferrule 65. The pen body 61 includes a holder 68 described later. The holder 68 is attached to the lower end of the pen body 61.

The optical fibers 64 define an optical transfer medium to transfer light applied from the light source 62. The optical fibers 64 include a core portion (not shown) through which light passes and a cladding portion (not shown) that surrounds the core portion and reflects light. The optical fibers 64 are connected to the light source 62. The optical fibers 64 include an upper end e1 extending to the outside of the pen body 61. The end e1 of the optical fibers 64 is inserted in a connector 62*a* included in the light source 62. With this configuration, the optical fibers 64 are connected to the light source 62 with a reduced optical loss. The optical fibers 64 include a lower end e2 equipped with the ferrule 65. The ferrule 65 is a cylindrical optical photojunction member. The ferrule 65 has a through hole 65*h* along the cylindrical axis. The end e2 of the optical fibers 64 is inserted in the through hole 65*h* of the ferrule 65. The optical fibers 64 are an example of a light guide.

The pen body 61 is provided with the holder 68. The holder 68 is a holding member disposed at the lower end of the pen body 61 and used to hold the ferrule 65 at a predetermined position. The holder 68 preferably has a cap shape, for example. An upper portion of the holder 68 preferably has a cylindrical shape whose outer diameter corresponds to the pen body 61, for example. A lower portion of the holder 68 includes a cylindrical projection 68*g* with an outer diameter smaller than that of the pen body 61. The projection 68*g* includes a ferrule holding portion 68*f* that is a cylindrical recess. The ferrule holding portion 68*f* has an inner diameter corresponding to the outer diameter of the ferrule 65. The ferrule holding portion 68*f* houses the lower end of the ferrule 65.

The holder 68 has an aperture P penetrating the holder 68 upward and downward. The core portion of the end e2 of the optical fibers 64 is exposed to the outside through the aperture P. That is, in bottom view, the core portion of the end e2 of the optical fibers 64 overlaps the aperture P. Accordingly, the holder 68 does not interfere with an optical path L of laser light. Consequently, laser light applied from the light source 62 is able to be emitted to the outside from the lower end of the pan body 61.

The holder 68 holds the pressing body 66 at a predetermined position on the lower end of the pen body 61. First, the pressing body 66 will be described. The pressing body 66 presses the thermal transfer foil 82. In this preferred embodiment, the pressing body 66 further presses the light absorption film 84. The pressing body 66 is detachably provided in the holder 68. In this preferred embodiment, the pressing body 66 preferably is spherical, for example. The pressing body 66 preferably is made of a hard material. The pressing body 66 is not strictly limited to a specific hardness, and is made of, for example, a material having a Vickers hardness of about 100 $HV_{0.2}$ or more (e.g., about 500 $HV_{0.2}$ or more). The holder 68 holds the pressing body 66 on the optical path L of laser light. The pressing body 66 is preferably made of a material through which laser light emitted from the light source 62 passes. Accordingly, even in a case where the pressing body 66 is disposed on the optical path L, laser light passes through the pressing body 66. The pressing body 66 may be made of, for example, glass. The pressing body 66 according to the present preferred embodiment may be made of synthetic quartz glass.

The term "transparent" as used herein means that a transmittance of laser light to the pressing body 66 is about 50% or more, preferably about 70% or more, more preferably about 80% or more, and especially more preferably 85% or more (e.g., about 90% or more), for example. This transmittance refers to a transmittance including a surface reflection loss of a sample having a predetermined thickness (e.g., about 10 mm) measured in accordance with JIS R3106:1998, for example.

Figure 5:
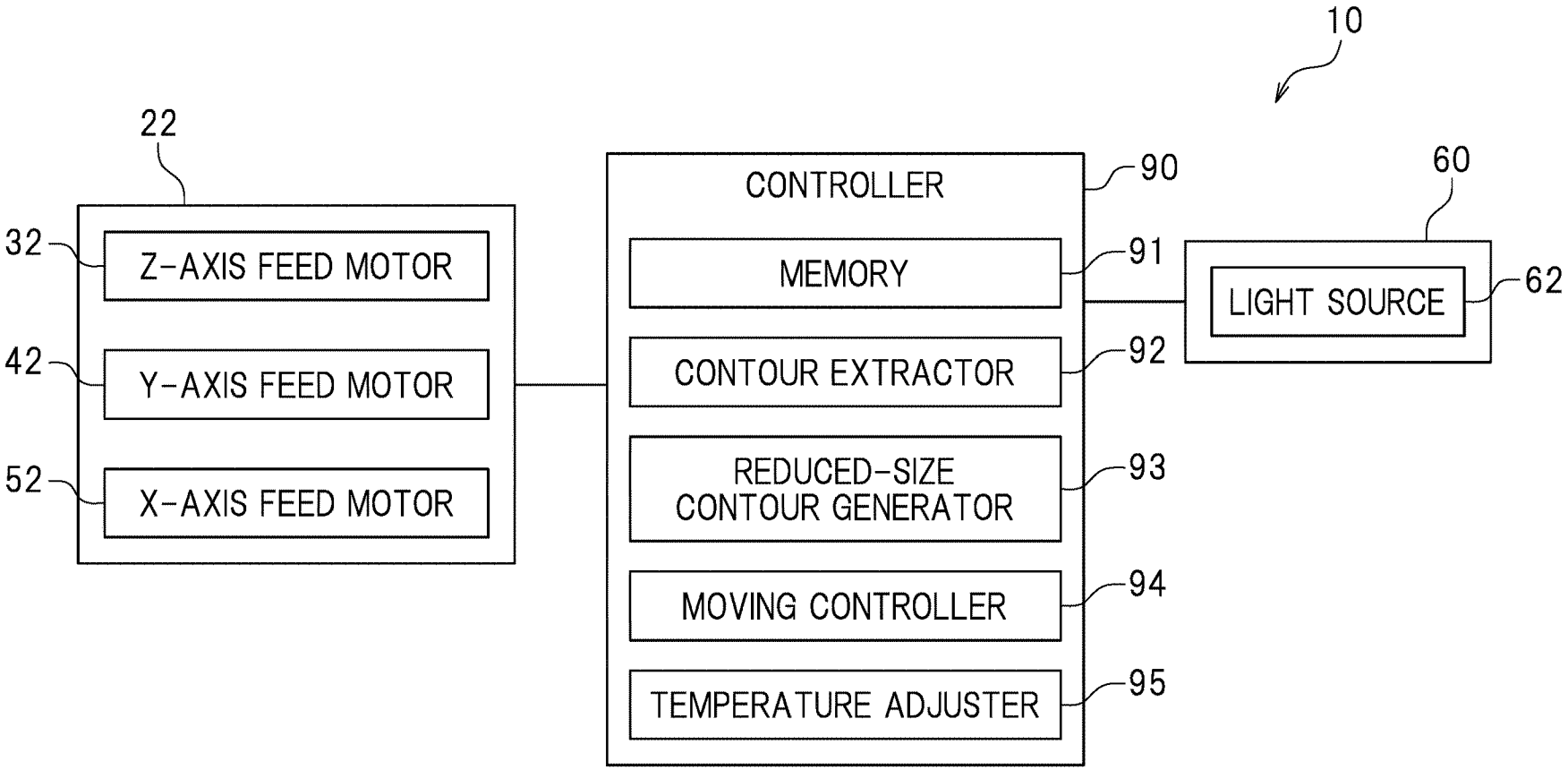
FIG. 5 is a block diagram of a thermal transfer apparatus according to a preferred embodiment of the present invention.

An overall operation of the thermal transfer apparatus 10 is controlled by the controller 90. As illustrated in FIG. 5, the controller 90 is communicably connected to the carriage moving mechanism 22 and the foil transfer tool 60 and is configured or programmed to enable control of the carriage moving mechanism 22 and the foil transfer tool 60. The controller 90 is communicably connected to the Z-axis feed motor 32, the Y-axis feed motor 42, the X-axis feed motor 52, and the light source 62 and is configured or programmed to enable control of these motors and the light source. The controller 90 is typically a computer. The controller 90 is configured or programmed to include, for example, an interface (I/F) that receives foil transfer data and other data from external equipment such as a host computer, a central processing unit (CPU) that executes instructions of a control program, a ROM that stores programs to be executed by the CPU, a RAM to be used as a working area where a program is developed, and a memory to store the programs and various types of data.

The controller 90 is configured or programmed to include a memory 91, a contour extractor 92, a reduced-size contour generator 93, a moving controller 94, and a temperature adjuster 95. The functions of these elements of the controller 90 may be implemented by a program. This program may be read from a recording medium such as a CD or a DVD. This program may be downloaded through the Internet. The functions of the elements of the controller 90 may be implemented by, for example, processor(s) and/or circuit(s). Specific control of each of the above-described elements of the controller 90 will be described later.

The memory 91 stores image data representing the shape (e.g., a figure or a character) of thermal transfer foil (decorative layer) to be transferred onto the transfer object 80. As the image data, the memory 91 stores image data in a vector format that represents the shape of thermal transfer foil in the vector format. In the image data in the vector format, information such as coordinates of a start point of a line, coordinates of an end point of the line, and attributes of the line (e.g., the width of the line or, in the case of a curve, the way of the curve) as numerical values.

Figure 6:
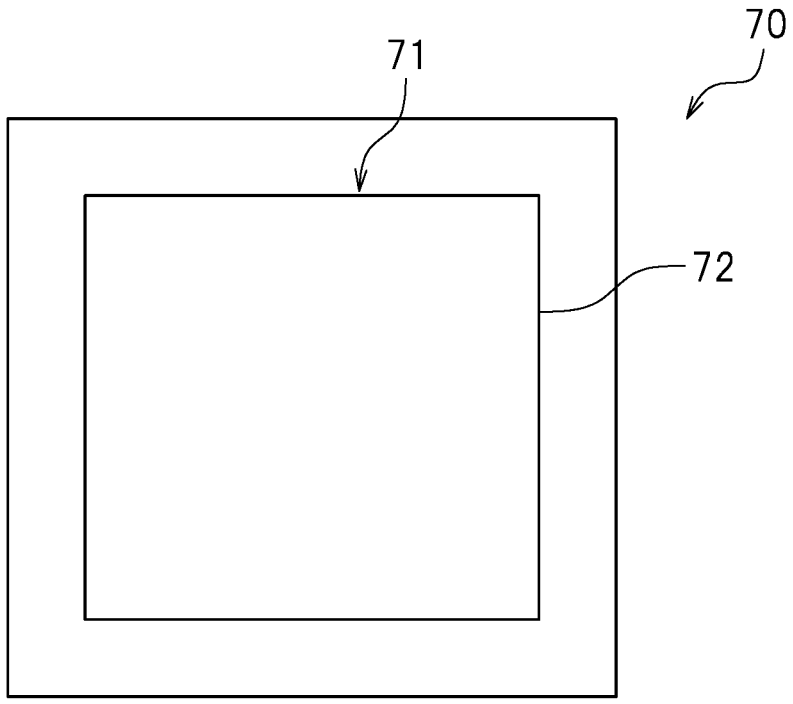
FIG. 6 is a schematic view illustrating an image representing a shape of foil to be transferred to a transfer object.

Based on the image data in the vector format, the contour extractor 92 extracts a contour of the shape of thermal transfer foil (decorative layer) to be transferred onto the transfer object 80. As illustrated in FIG. 6, the contour extractor 92 extracts a contour 72 of a shape 71 of thermal transfer foil in an image 70 represented by image data in a vector format. In this example, the shape 71 of thermal transfer foil is a square. Information on the contour 72 is stored in the memory 91.

Figure 7:
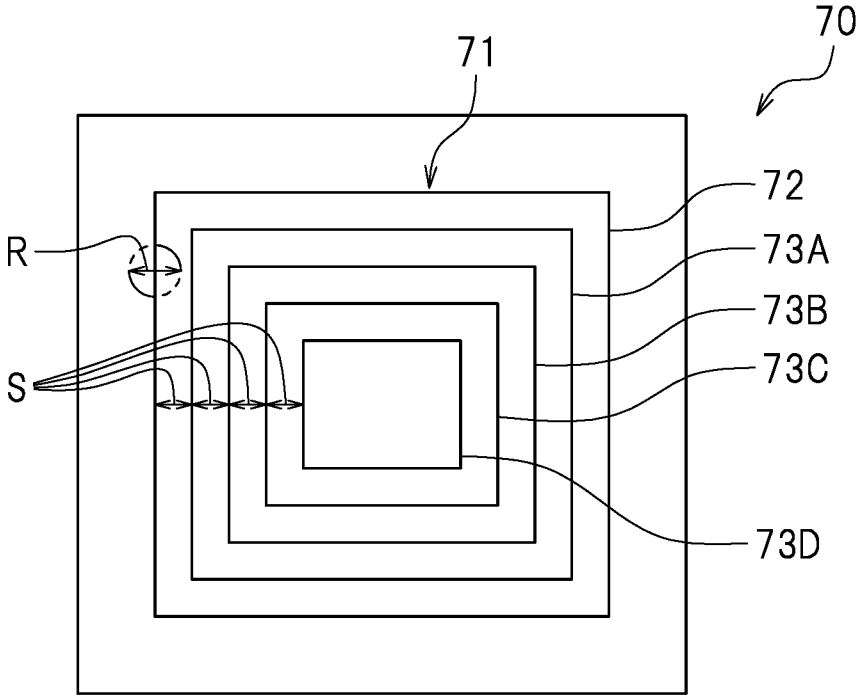
FIG. 7 is a schematic view illustrating a state in which a plurality of reduced-size contours are formed in a contour of the shape of foil.

As illustrated in FIG. 7, the reduced-size contour generator 93 generates a plurality of reduced-size contours 73A, 73B, 73C, and 73D in a contour 72 extracted by the contour extractor 92. The reduced-size contours 73A through 73D are formed by sequentially reducing the size of the contour 72 inward. The reduced-size contour 73A is formed by reducing the size of the contour 72 and is located inside the contour 72. The reduced-size contour 73B is formed by reducing the size of the contour 72 and is located inside the contour 73A. The reduced-size contour 73C is formed by reducing the size of the contour 72 and is located inside the contour 73B. The reduced-size contour 73D is formed by reducing the size of the contour 72 and is located inside the contour 73C. That is, the contour 72 is located at the outermost side. In this preferred embodiment, among the reduced-size contours 73A through 73D, the reduced-size contour 73D located farthest inward is the innermost reduced-size contour. The contour 72 are analogous to the reduced-size contours 73A through 73D. Information on the reduced-size contours 73A through 73D is stored in the memory 91. In this preferred embodiment, the reduced-size contour generator 93 creates the four reduced-size contours 73A through 73D, but may create five or more reduced-size contours or three or less reduced-size contours. Although the reduced-size contour generator 93 creates the reduced-size contours 73A through 73D with a predetermined spacing S, but the spacing between the reduced-size contours 73A through 73D may vary.

The moving controller 94 causes the foil transfer tool 60 to move relative to the fixture 20 by using the carriage moving mechanism 22 to press the thermal transfer foil 82 and the light absorption film 84 placed on the transfer object 80, and applies light to the light absorption film 84 to transfer the thermal transfer foil 82 onto the transfer object 80. The moving controller 94 causes the carriage 21 to move along the X axis, the Y axis, and the Z axis to thereby cause the foil transfer tool 60 to move. The moving controller 94 controls application and non-application of laser light from the light source 62. The moving controller 94 controls the carriage moving mechanism 22 such that the foil transfer tool 60 moves along the reduced-size contours 73A through 73D and the contour 72 in order from the innermost reduced-size contour 73D to the contour 72. That is, in this preferred embodiment, the moving controller 94 controls the carriage moving mechanism 22 such that the foil transfer tool 60 moves along the reduced-size contours 73A through 73D and the contour 72 in the order of the reduced-size contour 73D, the reduced-size contour 73C, the reduced-size contour 73B, the reduced-size contour 73A, and the contour 72. The moving controller 94 controls the carriage moving mechanism 22 based on information on the contour 72 and information on the reduced-size contours 73A through 73D stored in the memory 91. The moving controller 94 is capable of transferring the thermal transfer foil 82 onto the transfer object 80 along the reduced-size contours 73A through 73D and the contour 72.

The moving controller 94 controls the carriage moving mechanism 22 to adjust the distance between the foil transfer tool 60 and the transfer object 80 in the top-bottom directions. In this manner, a spot diameter of laser light applied from the light source 62 of the foil transfer tool 60 can be adjusted. As illustrated in FIG. 7, the moving controller 94 enables adjustment so that the spot diameter R is larger than the predetermined spacing S. The moving controller 94 also enables adjustment such that the spot diameter R is equal to the predetermined spacing S.

The temperature adjuster 95 adjusts a temperature in heating the thermal transfer foil 82 by the foil transfer tool 60. In this preferred embodiment, the temperature adjuster 95 is configured or programmed to adjust energy of light applied from the light source 62 of the foil transfer tool 60. While the foil transfer tool 60 moves along the reduced-size contours 73A through 73D and the contour 72, the temperature adjuster 95 gradually reduces the temperature in order from the innermost reduced-size contour 73D to the outermost contour 72. In the example illustrated in FIG. 7, the temperature decreases in the order of the reduced-size contour 73D, the reduced-size contour 73C, the reduced-size contour 73B, the reduced-size contour 73A, and the contour 72. That is, the temperature in moving the foil transfer tool 60 along the reduced-size contour 73D is the highest, and the temperature in moving the foil transfer tool 60 along the contour 72 is the lowest.

As described above, in the thermal transfer apparatus 10 according to this preferred embodiment, the moving controller 94 controls the carriage moving mechanism 22 such that the foil transfer tool 60 moves along the reduced-size contours 73A through 73D and the contour 72 in order from the innermost reduced-size contour 73D to the outermost contour 72. In this manner, transfer of the thermal transfer foil 82 onto the transfer object 80 is sequentially performed from the inner side to the outer side of the contour 72, and thus, occurrence of crinkles of the thermal transfer foil 82 are reduced or prevented during foil transfer so that the thermal transfer foil 82 is able to be more accurately transferred onto the transfer object 80.

In the thermal transfer apparatus 10 according to this preferred embodiment, the spot diameter R of laser light emitted from the light source 62 is equal or substantially equal to the predetermined spacing S. Accordingly, the thermal transfer foil 82 is able to be transferred onto the transfer object 80 without gaps over the entire or substantially the entire regions between adjacent ones of the reduced-size contours 73A through 73D and the contour 72.

In the thermal transfer apparatus 10 according to this preferred embodiment, the spot diameter R of laser light emitted from the light source 62 may be larger than the predetermined spacing S. Accordingly, after the foil transfer tool 60 moves along the reduced-size contour 73D so that the thermal transfer foil 82 is transferred onto the transfer object 80 along the reduced-size contour 73D, and when the foil transfer tool 60 moves along the reduced-size contour 73C located outside the reduced-size contour 73D, a portion previously heated by the foil transfer tool 60 (i.e., a portion near the reduced-size contour 73D) is heated again so that the transfer object 80 and the thermal transfer foil 82 are more firmly bonded in this portion.

In the thermal transfer apparatus 10 according to this preferred embodiment, the pressing body 66 is detachably provided on the holder 68 of the pen body 61. Since the pressing body 66 is used while being in contact with the thermal transfer foil 82, the pressing body 66 is gradually abraded. In this preferred embodiment, it is necessary to replace only the pressing body 66, and thus, replacement is able to be performed easily at low costs, as compared to the case of replacing the entire foil transfer tool 60.

In the thermal transfer apparatus 10 according to this preferred embodiment, in moving the foil transfer tool 60 along the reduced-size contours 73A through 73D and the contour 72, the temperature adjuster 95 gradually reduces the temperature in heating the thermal transfer foil 82 by the foil transfer tool 60 in order from the innermost reduced-size contour 73D to the contour 72 at the outermost side. Heat is sequentially applied to the thermal transfer foil 82 from the inside to the outside of the contour 72, and the applied heat is able to be radially diffused to the outside. Thus, when heating is performed at the same temperature, the amount of heat applied to the thermal transfer foil 82 might increase excessively toward the outside. In view of this, the temperature is gradually reduced from the inside to the outside of the contour 72 to prevent excessive application of heat to the thermal transfer foil 82, thus reducing quality degradation of the thermal transfer foil 82 transferred onto the transfer object 80.

Second Preferred Embodiment

Figure 8:
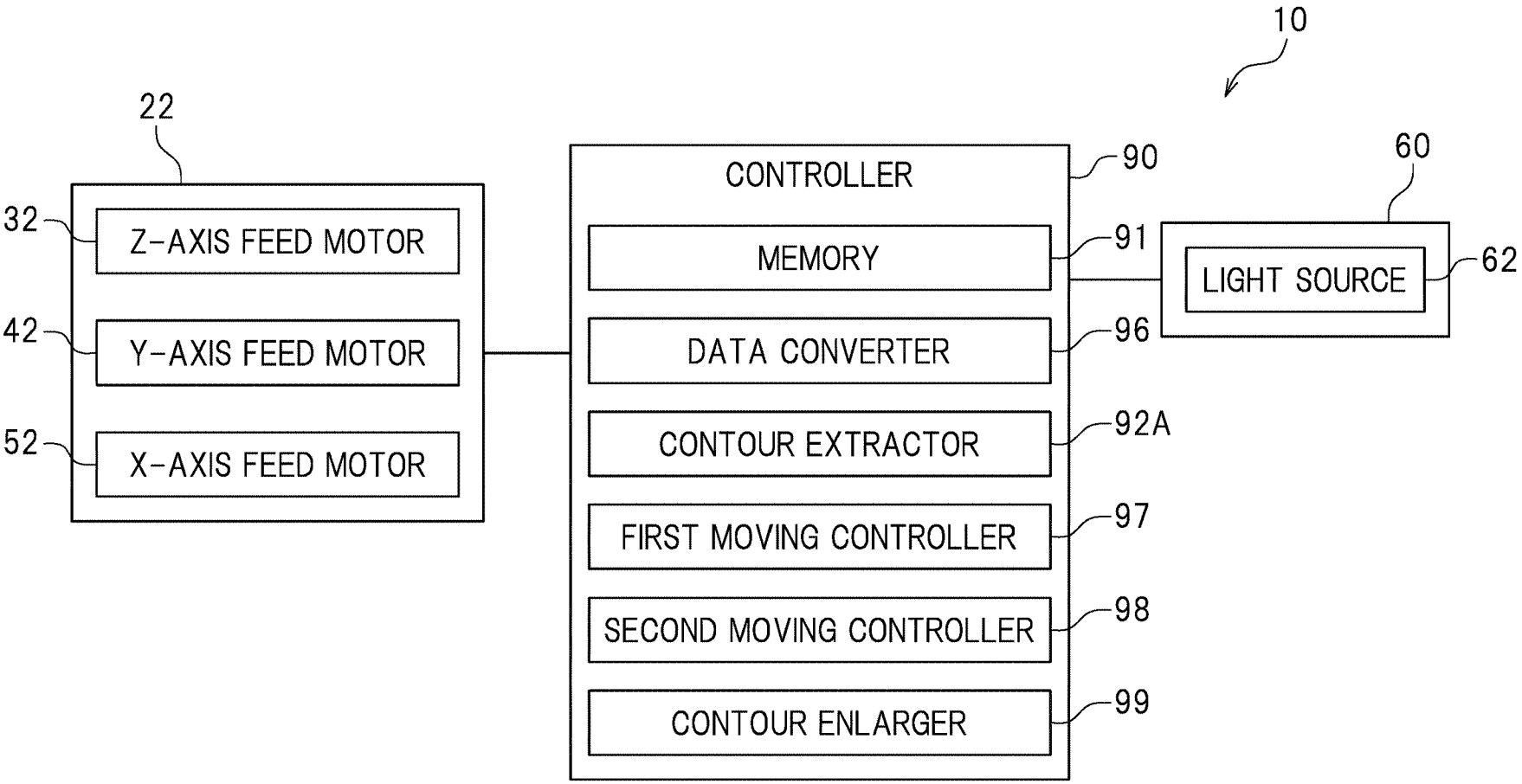
FIG. 8 is a block diagram of a thermal transfer apparatus according to another preferred embodiment of the present invention.

FIG. 8 is a block diagram of a thermal transfer apparatus 10 according to a second preferred embodiment of the present invention. As illustrated in FIG. 8, a controller 90 is configured or programmed to include a memory 91, a data converter 96, a contour extractor 92A, a first moving controller 97, a second moving controller 98, and a contour enlarger 99. The functions of these elements of the controller 90 may be implemented by a program. This program may be read from a recording medium such as a CD or a DVD. This program may be downloaded through the Internet. The functions of the elements of the controller 90 may be implemented by, for example, processor(s) and/or circuit(s). Specific control of each of the above-described elements of the controller 90 will be described later.

Figure 9:
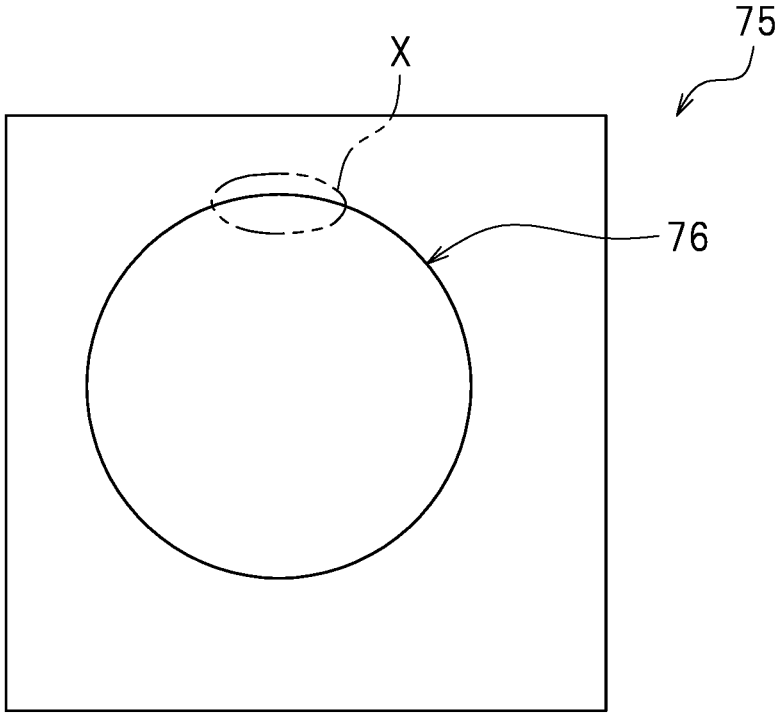
FIG. 9 is a schematic view illustrating an image representing a shape of foil to be transferred to a transfer object.
Figure 10:
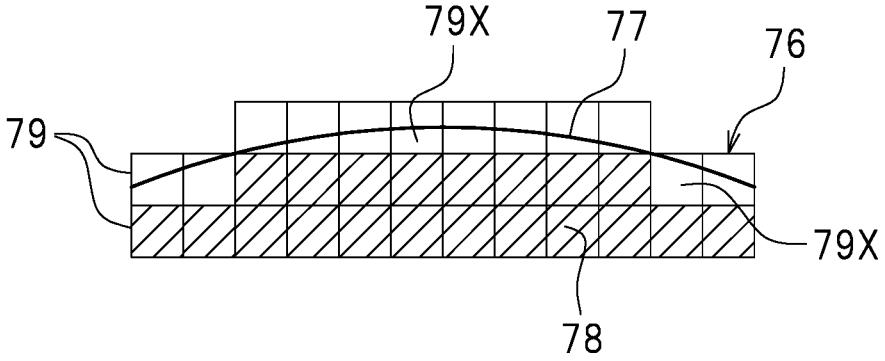
FIG. 10 is an enlarged view of a portion X in FIG. 9, where an image of a contour represented in a vector format is superimposed on an image represented in a raster format.

The memory 91 stores image data representing the shape (e.g., a figure or a character) of thermal transfer foil (decorative layer) to be transferred onto a transfer object 80. As the image data, the memory 91 stores image data in a raster format in which the shape of thermal transfer foil is represented in the raster format. The image data in the raster format stores information on color and concentration for each pixel. FIG. 9 shows an example of a shape 76 of thermal transfer foil in an image 75 represented by image data in a raster format. In this example, the shape 76 of thermal transfer foil is a circle. As illustrated in FIG. 10, in the image 75 represented by the image data in the raster format, jaggies occur on the contour of the shape 76.

The data converter 96 converts the image data in the raster format to image data in a vector format. The conversion from the image data in the raster format to the image data in the vector format can be performed by a known method. Conversion from the image data in the raster format to the image data in the vector format is able to be uniquely performed based on bitmap data, for example. The converted image data in the vector format is stored in the memory 91.

Figure 11:
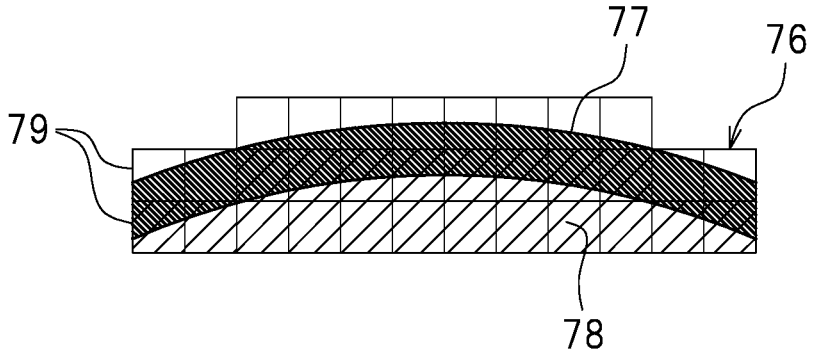
FIG. 11 is a view illustrating an image with a bold contour represented in a vector format.

Based on the image data in the vector format, the contour extractor 92A extracts a contour of the shape of thermal transfer foil (decorative layer) to be transferred onto the transfer object 80. The contour extractor 92A extracts a contour 77 of the shape 76 of thermal transfer foil based on the image data in the vector format (see FIG. 10). Information on the contour 77 is stored in the memory 91. In FIG. 10 and FIG. 11 described later, the contour 77 is disposed in an image represented by the image data in the raster format, but the image and the contour are processed as different pieces of data in application.

The first moving controller 97 and the second moving controller 98 cause a foil transfer tool 60 to move relative to a fixture 20 by using a carriage moving mechanism 22 to press a thermal transfer foil 82 and a light absorption film 84 placed on the transfer object 80 and applies light to the light absorption film 84 to transfer the thermal transfer foil 82 onto the transfer object 80. The first moving controller 97 and the second moving controller 98 cause a carriage 21 to move along the X axis, the Y axis, and the Z axis to cause the foil transfer tool 60 to move. The first moving controller 97 and the second moving controller 98 control application and non-application of laser light from a light source 62.

The first moving controller 97 controls the carriage moving mechanism 22 such that the foil transfer tool 60 moves along the contour 77. The first moving controller 97 controls the carriage moving mechanism 22 based on image data in the vector format. The first moving controller 97 is able to transfer the thermal transfer foil 82 onto the transfer object 80 along the contour 77.

Based on image data in the raster format, the second moving controller 98 controls the carriage moving mechanism 22 so that the foil transfer tool 60 moves in units of pixels 79 in a region 78 inside the contour 77. Before the contour 77 becomes wide by the contour enlarger 99 described later, the region 78 does not overlap the contour 77. The second moving controller 98 is able to transfer the thermal transfer foil 82 onto the transfer object 80 over the entire region 78. In the example illustrated in FIG. 10, hatched pixels 79 correspond to the region 78. After movement of the foil transfer tool 60 by the second moving controller 98 is completed (i.e., after the thermal transfer foil 82 is transferred onto the transfer object 80 over the entire region 78), the first moving controller 97 preferably controls the carriage moving mechanism 22 such that the foil transfer tool 60 moves along the contour 77.

The contour enlarger 99 enlarges the contour 77 extracted by the contour extractor 92A toward the inside of the contour 77. FIG. 11 is an example in which the contour 77 illustrated in FIG. 10 is enlarged inward. The width of the contour 77 is able to be made at an intended width. A portion where the contour 77 and the region 78 overlap is irradiated with laser light from the light source 62 in duplicate.

As described above, in the thermal transfer apparatus 10 according to this preferred embodiment, the first moving controller 97 controls the carriage moving mechanism 22 such that the foil transfer tool 60 moves along the contour 77. Thus, jaggies do not occur on the contour of the thermal transfer foil 82 transferred onto the transfer object 80. Based on the image data in the raster format, the second moving controller 98 controls the carriage moving mechanism 22 such that the foil transfer tool 60 moves in units of pixels 79 in the region 78 inside the contour 77. Thus, the thermal transfer foil 82 is able to be transferred onto the transfer object 80 without gaps over the entire or substantially the entire region 78 inside the contour 77. In this manner, the foil transfer tool 60 is caused to move using different pieces of data for portions of shapes of the thermal transfer foil 82 to be transferred onto the transfer object 80 so that the thermal transfer foil 82 is able to be more accurately transferred onto the transfer object 80.

In the thermal transfer apparatus 10 according to this preferred embodiment, the first moving controller 97 controls the carriage moving mechanism 22 such that the foil transfer tool 60 moves along the contour 77 after movement of the foil transfer tool 60 by the second moving controller 98 is completed. In this manner, since the thermal transfer foil 82 is first transferred onto the transfer object 80 inside the contour 77 and then onto the transfer object 80 in the contour 77, occurrence of crinkles of the thermal transfer foil 82 during foil transfer is reduced or prevented so that the thermal transfer foil 82 is able to be more accurately transferred onto the transfer object 80.

In the thermal transfer apparatus 10 according to this preferred embodiment, the contour enlarger 99 enlarges the contour 77 extracted by the contour extractor 92A toward the inside of the contour 77. Since the thermal transfer foil 82 is transferred in units of pixels 79 in the region 78 inside the contour 77, a small gap 79X can occur between the contour 77 and the region 78 inside the contour 77. However, by enlarging the contour 77, the gap 79X is able to be reduced or prevented.

The foregoing description is directed to the preferred embodiments of the present invention. The preferred embodiments described above, however, are merely examples, and the present invention can be performed in various modes.

In the preferred embodiments, the foil transfer tool 60 moves relative to the fixture 20, for example. However, the present invention is not limited to this example. In the thermal transfer apparatus 10, the fixture 20 may move relative to the foil transfer tool 60 or both the fixture 20 and the foil transfer tool 60 may be movable. For example, the fixture 20 may be movable along the X axis with the foil transfer tool 60 being movable along the Y axis and the Z axis.

In the preferred embodiments described above, the pressing body 66 is a sphere, for example. The pressing body 66, however, is not limited to this shape. For example, the pressing body 66 may be a hemisphere or a rectangular parallelepiped.

In the preferred embodiments, laser light is applied from the light source 62 of the foil transfer tool 60 to the thermal transfer foil 82. However, the present invention is not limited to this example. The foil transfer tool 60 may be configured or structured to enable heating of the pressing body 66 and push the heated pressing body 66 against the thermal transfer foil 82.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A thermal transfer apparatus comprising:

a stand that holds a transfer object;

a foil transfer tool that presses a thermal transfer foil placed on the transfer object and heats the thermal transfer foil to transfer the thermal transfer foil having a shape onto the transfer object;

a moving mechanism that moves one of the stand and the foil transfer tool relative to the other of the stand and the foil transfer tool; and a controller communicably connected to the foil transfer tool and the moving mechanism to control the foil transfer tool and the moving mechanism; wherein the controller includes:

a memory that stores image data in a vector format representing the shape in the vector format;

a contour extractor that extracts a contour of the shape based on the image data in the vector format;

a reduced-size contour generator that generates a plurality of reduced-size contours inside the contour by sequentially reducing the contour extracted by the contour extractor inward; and a moving controller that controls the moving mechanism such that the foil transfer tool moves along the plurality of reduced-size contours and the contour in order from an innermost reduced-size contour to the contour, the innermost reduced-size contour being one of the plurality of reduced-size contours located at an innermost side, the contour is located at an outermost side among the plurality of reduced-size contours and the contour.

2. The thermal transfer apparatus according to claim 1, wherein:

the foil transfer tool includes:

a hollow pen body including a front end;

a pressing body disposed at the front end of the hollow pen body to press the transfer foil placed on the transfer object;

a light guide including a first end and a second end and at least partially disposed in the hollow pen body; and a light source connected to the first end of the light guide;

the second end of the light guide is disposed at the front end of the hollow pen body to face the pressing body in the hollow pen body;

the pressing body is made of a material through which laser light from the light source passes; and the laser light has a spot diameter equal or substantially equal to a predetermined spacing between adjacent reduced-size contours of the plurality of reduced-size contours.

3. The thermal transfer apparatus according to claim 1, wherein:

the foil transfer tool includes:

a hollow pen body including a front end;

a pressing body disposed at the front end of the hollow pen body to press the transfer foil placed on the transfer object;

a light guide including a first end and a second end and at least partially disposed in the hollow pen body; and a light source connected to the first end of the light guide;

the second end of the light guide is disposed at the front end of the hollow pen body to face the pressing body in the hollow pen body;

the pressing body is made of a material through which laser light from the light source passes; and the laser light has a spot diameter larger than a predetermined spacing between adjacent reduced-size contours of the plurality of reduced-size contours.

4. The thermal transfer apparatus according to claim 2, wherein the pressing body is detachably disposed at the front end of the hollow pen body.

5. The thermal transfer apparatus according to claim 1, wherein the controller includes a temperature adjuster that adjusts a temperature in heating the thermal transfer foil with the foil transfer tool; and the temperature adjuster reduces the temperature in order from the innermost reduced-size contour to the contour at the outermost side when the foil transfer tool moves along the plurality of reduced-size contours and the contour.

6. A thermal transfer apparatus comprising:

a stand that holds a transfer object;

a foil transfer tool that presses a thermal transfer foil placed on the transfer object and heats the thermal transfer foil to transfer the thermal transfer foil having a shape onto the transfer object;

a moving mechanism that moves one of the stand and the foil transfer tool relative to the other of the stand and the foil transfer tool; and a controller communicably connected to the foil transfer tool and the moving mechanism to control the foil transfer tool and the moving mechanism; wherein the controller includes:

a memory that stores raster image data in a raster format representing the shape in the raster format;

a data converter that converts the raster image data in the raster format to vector image data in a vector format;

a contour extractor that extracts a contour of the shape based on the vector image data in the vector format;

a first moving controller that controls the moving mechanism such that the foil transfer tool moves along the contour; and a second moving controller that controls the moving mechanism based on the raster image data in the raster format such that the foil transfer tool moves in units of pixels in a region inside the contour.

7. The thermal transfer apparatus according to claim 6, wherein the first moving controller controls the moving mechanism such that the foil transfer tool moves along the contour after movement of the foil transfer tool by the second moving controller is completed.

8. The thermal transfer apparatus according to claim 6, wherein the controller includes a contour enlarger that enlarges the contour extracted by the contour extractor toward inside of the contour.

* * * * *